US005901468A

United States Patent [19]

Whyte

[11] Patent Number: 5,901,468

[45] Date of Patent: May 11, 1999

[54] FLEXIBLE FOOT SUPPORT INSERT FOR ATHLETIC SHOE, AND THE LIKE

[76] Inventor: Robert S. Whyte, 28361 Lanuza, Mission Viejo, Calif. 92692

[21] Appl. No.: 08/831,134

[22] Filed: Apr. 1, 1997

[51] Int. Cl.[6] ..... A43B 19/00; A43B 13/38

[52] U.S. Cl. ..... 36/71; 36/43; 36/44

[58] Field of Search ..... 36/43, 44, 71, 36/155, 102, 88, 91, 92, 142, 143, 144, 93

[56] References Cited

U.S. PATENT DOCUMENTS

| | | | |
|---|---|---|---|
| 315,254 | 4/1885 | Day | 36/44 |
| 1,111,361 | 4/1914 | Carr | 36/44 |
| 1,142,848 | 6/1915 | Scholl | 36/44 |
| 1,566,106 | 12/1925 | Lamb . | |
| 1,792,677 | 2/1931 | Cook . | |
| 2,404,731 | 7/1946 | Johnson | 36/44 |
| 4,266,350 | 5/1981 | Laux | 36/44 |
| 4,571,857 | 2/1986 | Castellanos | 36/44 |
| 4,813,157 | 3/1989 | Boisvert et al. | 36/44 |
| 5,154,682 | 10/1992 | Kellerman | 36/44 |

*Primary Examiner*—M. D. Patterson
*Attorney, Agent, or Firm*—Willie Krawitz

[57] ABSTRACT

A variably flexible insert, or sets of inserts for an athletic shoe is provided which absorbs and distributes a portion of the user's weight. The insert is constructed of an injection molded plastic defining a plurality of horizontal slot or score lines which penetrate partially or completely through the insert. A series of perforations terminate the ends of the score lines which prevent or reduce cracking propagation of the score lines, and impart greater flexibility to portions of the insert. In one embodiment, the inserts are secured within the athletic shoe by adhesive pads. In another embodiment, foam friction pads are adhesively mounted or laminated on one or both sides of the flexible inserts, and this provides a non-skid surface within the running shoe and along the user's foot, as well as a certain amount of cushioning.

5 Claims, 1 Drawing Sheet

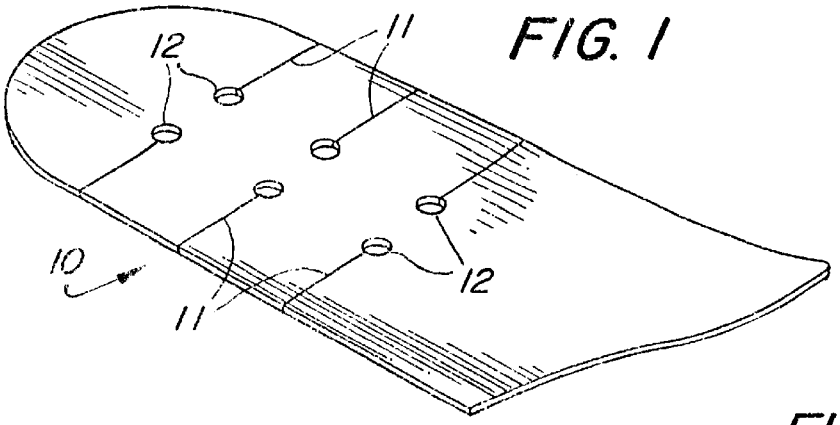
FIG. 1
FIG. 5
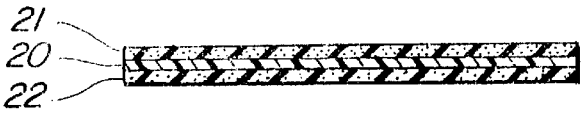
FIG. 2
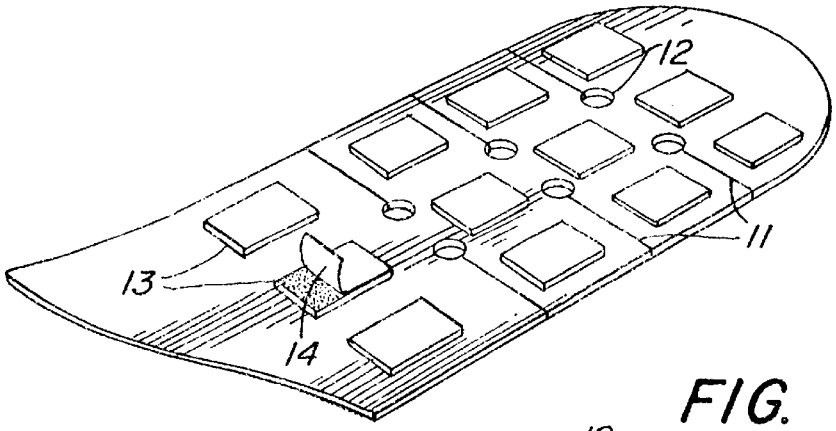
FIG. 4
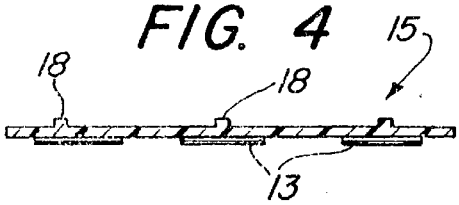
FIG. 3
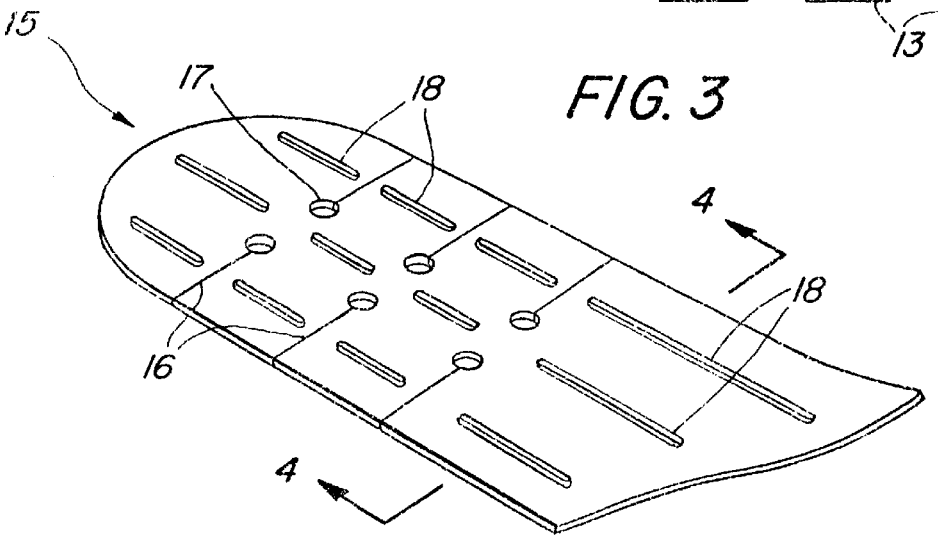

FLEXIBLE FOOT SUPPORT INSERT FOR ATHLETIC SHOE, AND THE LIKE

BACKGROUND OF THE INVENTION

This invention relates to a new and improved insert for shoes, particularly athletic shoes, and more specifically to an insert which spreads a user's weight over a wider area of the midsole, and is sufficiently variable in flexibility to impart greater user comfort when walking or running.

Numerous publications have dealt with inserts for running shoes, and some publications in this field include U.S. Pat. Nos. 3,999,558; 4,486,964; 4,654,984; 4,686,993; 4,800,657; 4,823,420; 4,888,888; 4,894,934; 4,905,383; 5,014,706; 5,311,680; 5,345,701; 5,353,523; 5,396,718; 5,400,528; 5,437,110; 5,513,448; 5,438,768; 5,488,786; 5,511,324; and, 5,528,842.

However, these patents do not provide inserts having the requirements of being sufficiently thin to produce a comfortable fit within the shoe while still imparting some cushioning properties, along with variable flexibility. This allows the user to change the midsole response of the shoe to user requirements.

THE INVENTION

According to the invention, there is provided inserts for shoes, such as athletic shoes, and the like which comprises one or more thin, flexible plates of plastic, metal, or composite material which fit into the bottom of each shoe and extend from the heel of the shoe to about the arch of the foot, and width-wise of the shoe. The plates function to spread the impact of foot strike and support the weight of the wearer and to decrease the compression of the midsole and thus the articulation of the ankle. This reduces the tendency of achilles tendon problems and, prevents excess softness and instability at the heel portion of the shoe.

To impart variable flexibility, a plurality of slots or score lines are defined transversely or inclined along the length of the insert, and the slots may be extend completely or partially through the insert. A plurality of bores or depressions are defined about midway of each insert where the end of a slot or score line terminates, and are designed to prevent or reduce crack propagation, and to provide additional insert flexibility.

If desired, stiffening ridges may be provided to increase stiffness or flexibility, depending on user requirements.

The inserts may be mounted within the shoe by means of adhesive pads fastened to one or both sides of the insert, or by friction pads adhesively secured to one or both sides of the insert, or both. Use of friction pads mounted on each side of an insert is preferred since this arrangement will secure the insert within the wearer's shoe and also prevent slippage of the foot along the insert surface. Additionally, use of friction pads rather than adhesive pads make it easier to remove an insert from a shoe when the insert becomes worn, or if a replacement becomes necessary or desired to change the fit, and to permit the insert to be employed in more than one pair of shoes.

BRIEF DESCRIPTION OF THE DRAWINGS

FIG. 1 is an upper, perspective view of an insert according to the invention;

FIG. 2 a lower, perspective view of the insert of FIG. 1;

FIG. 3 is an upper, perspective view of an insert similar to FIG. 1 showing longitudinal strengthening ribs embossed on the surface of the insert;

FIG. 4 is a cross sectional view, in side elevation taken along lines 4—4 of FIG. 3; and, FIG. 5 is a cross sectional view similar to FIG. 4 showing another embodiment of the invention employing friction pads adhesively secured on each side of the insert.

DESCRIPTION OF THE PREFERRED EMBODIMENTS

One embodiment of the invention is shown in FIG. 1, and comprises a thin plate 10 of polypropylene formed by injection molding, stamping, etc., and extending from the heel to the arch of the foot, or about 40% of the wearer's foot length.

One or more transverse sets of weakening slots 11 are defined along a portion of the insert length and preferably extend through the insert, and the interior ends of each slot are terminated by corresponding bores 12 to reduce crack propagation, and to impart additional transverse flexibility to the insert. The weakening slots may cut by the user, or may be formed at the factory, and function to accommodate the gait characteristics of the user.

The bottom of the insert is shown in FIG. 2 and comprises a plurality of two-sided adhesive pads 13, each pad being covered by tear strips 14 which are removed to expose the adhesive portion when the insert is installed into a shoe. Generally, adhesive pads and/or non skid pads are typically used in conjunction with fairly rigid inserts such as polypropylene.

Stiffening ribs may be defined along the insert, FIG. 3 showing an insert 15 defining transverse slots 16, corresponding terminating bores 17, and stiffening ribs 18.

In place of, or in conjunction with adhesive pads 13, another embodiment of the invention is shown in FIG. 5, and comprises an insert 20 providing friction pads 21, 22 adhesively secured or laminated to each side of the insert. Commercial production of the inserts shown in FIG. 5 is the presently contemplated preferred embodiment of the invention. The friction pads are about 1/32"–3/32", and preferably 1/16" thick and manufactured of foam material such as open or closed pore natural rubber, EVA, foam polyurethane, elastomer, neoprene foam, rubber, etc., to impart a non-skid surface and provide cushioning.

Individual friction pads may be factory installed or applied to an insert by the user, or the friction pads may be integrally formed with an insert as part of an injection molding process. Obviously, more than one friction pad may be employed alone or on each side of an insert, depending on user requirements.

Suitable flexible plastic sheet materials of construction which may be used include polypropylene, polyethylene, nylon, polyester, PVC, epoxy reinforced with graphite, glass, chopped fiber, etc., copolyester elastomer, polyurethane, vinyl polymers, polycarbonate, etc. Of the various polymers, the presently preferred material is polypropylene, and aluminum sheet is also a candidate. When using a non-skid material such as variably flexible PVC, the friction pads 21, 22 may be eliminated.

The polypropylene insert thickness may vary from about 0.01" to 0.25", suitable slot dimensions of the transverse slots 11 vary from about up to about 4 mm wide; 10–60 mm long; the slots are about 3 to 35 mm apart; and, about 1–50 slots, or sets of slots may be defined along the insert length. Present manufacturing slot dimensions are about 1 mm wide, 40 mm long, 45° from the side to center, and slot spacings are about 15 mm apart. The diameter of a bore 12 may vary from about 1/32"–1/2", and a preferred bore size is about 3/8" in diameter.

Typically, the inserts and friction pads are sold in sets of various thicknesses and flexibility, and the user selects the set which provides the best initial response. When properties of a particular foot strike have been established, a user can select one or more combination of plate or plates, thicknesses and weakening slots to produce the most desirable response.

By means of forming slots or score lines along the insert, the integrity of the insert can be diminished or varied in a particular area, thereby making the insert more flexible and less able to transfer laterally the weight of the user. This permits the user to soften areas of the plate and map or tune the response of an athletic shoe more closely to meet individual requirements regarding weight, and/or foot strike characteristics.

I claim:

1. A method of tuning a shoe response to user requirements, including weight and foot strike characteristics, which comprises:

a.) inserting at least one thin, variably flexible plate insert constructed of a material selected from the class consisting of plastic, composite and metal, the plate extending from about heel-to-arch of the shoe;

b.) forming a plurality of weakening slots defined along the insert, and extending inwardly of the insert, the slots imparting flexibility to the insert; and, c.) forming a plurality of bores, each bore being defined at the termination of a weakening slot to reduce crack propagation, and to impart increased flexibility to the insert, the integrity of the insert being weakened in an area adjacent the weakening slots, thereby enabling a user to weaken areas of the plate and modify the response of the shoe more closely to individual requirements, including weight and foot strike characteristics, on the weakened areas of the insert, the inserts functioning to spread the impact of foot strike, and support the weight of the wearer and to decrease compression of the midsole, and hence the articulation of the ankle, the insert comprising adhesive means mounted on at least one side of the insert to secure the insert within the shoe, and to improve friction between a user and the insert, the insert being provided in sets of various thicknesses and flexibility to enable a user to select a set of inserts which provide a best initial response, and when properties of a particular foot strike have been established, a user can select one or more combination of plate or plates, thicknesses and weakening slots to soften areas of an insert and produce the most desirable response, thereby changing the midsole response of the shoe to user requirements.

2. The method of claim 1, in which the insert thicknesses are about 0.01"–0.25", the insert length is about 40% of the shoe length, the weakening slot dimensions are about 4 mm wide, about 10 mm–60 mm long,the slots are about 3 mm–35 mm apart, and about 1–50 slots are defined along the insert length, and bore diameters are about 1/32"–3/8".

3. The method of claim 1, in which the insert is constructed of a material selected from the class consisting of polypropylene, polyethylene, nylon, polyester, PVC, epoxy reinforced with graphite, glass or chopped fiber, copolyester elastomer, polyurethane, vinyl polymers, polycarbonate, and aluminum sheet.

4. The method of claim 1, in which the non-skid means is selected from the class consisting of open and closed pore foam material, natural foam rubber, EVA, foam polyurethane, foam elastomer, isoprene foam, and rubber.

5. The method of claim 4, in which the non-skid means are about 1/32"–3/32 in thickness.

* * * * *